US011511839B1

(12) United States Patent
Peng

(10) Patent No.: US 11,511,839 B1
(45) Date of Patent: Nov. 29, 2022

(54) BUILT-IN WATER PUMPING DEVICE OF MANUAL PADDLE FOR BOAT

(71) Applicant: I-Sin Peng, Taichung (TW)

(72) Inventor: I-Sin Peng, Taichung (TW)

( * ) Notice: Subject to any disclaimer, the term of this patent is extended or adjusted under 35 U.S.C. 154(b) by 0 days.

(21) Appl. No.: 17/331,796

(22) Filed: May 27, 2021

(51) Int. Cl.

| | |
|---|---|
| ***F04B 19/04*** | (2006.01) |
| ***B63H 16/04*** | (2006.01) |
| ***F04B 53/10*** | (2006.01) |
| ***F04B 9/14*** | (2006.01) |
| *B63B 13/00* | (2006.01) |

(52) U.S. Cl.
CPC ..... *B63H 16/04* (2013.01); *F04B 9/14* (2013.01); *F04B 19/04* (2013.01); *F04B 53/10* (2013.01); *B63B 13/00* (2013.01)

(58) Field of Classification Search
CPC .... B63H 16/04; F04B 19/04; F04B 33/00–02; F04B 53/10; F04B 9/14; B63B 13/00
See application file for complete search history.

(56) References Cited

U.S. PATENT DOCUMENTS 3,006,282 A * 10/1961 Sisson ..... B63B 13/00 92/170.1
3,040,693 A * 6/1962 Bunker ..... B63B 21/54 114/221 R
3,044,410 A * 7/1962 Edmundson ..... B63H 16/04 416/74
3,095,825 A * 7/1963 Sandberg ..... F16B 7/1427 417/313
3,165,067 A * 1/1965 Greenwald ..... B63B 21/54 114/221 R
3,319,577 A * 5/1967 Herreshoff ..... F04B 9/14 417/511
3,800,734 A * 4/1974 Whang ..... B63H 16/04 440/31
5,163,778 A * 11/1992 Botero ..... B63B 13/00 114/221 R
5,322,462 A * 6/1994 Hull ..... B63H 16/04 114/221 R (Continued)

FOREIGN PATENT DOCUMENTS

CA 2714684 A1 * 3/2012 ..... B63B 13/00
DE 202021102928 U1 * 7/2021 ..... B63B 13/00

(Continued)

*Primary Examiner* — Thomas Fink
(74) *Attorney, Agent, or Firm* — Alan D. Kamrath; Karin L. Williams; Mayer & Williams PC

(57) ABSTRACT

A built-in water pumping device of a manual paddle for a boat contains: a shaft, a blade, and a water absorption head. The shaft includes an inner tube and an outer tube movably fitted with the inner tube so as to movably adjust a length of the shaft, thus pumping waters. An adjustable fitting sleeve is configured to lock or unlock the inner tube and the outer tube after adjusting the length of the shaft. The shaft includes a receiving chamber. A water absorption head is fixed on the outer tube and has a passing orifice. The blade includes at least one outlet communicating with the receiving chamber, such that the inner tube is actuated to absorb the waters into the receiving chamber from the passing orifice, and the inner tube is pulled back and forth so that the waters discharge out of the at least one outlet continuously.

4 Claims, 10 Drawing Sheets

(56) References Cited

U.S. PATENT DOCUMENTS

| | | | | | |
|---|---|---|---|---|---|
| D362,834 | S | * | 10/1995 | Stout | D12/215 |
| 5,902,162 | A | * | 5/1999 | Kot | B63H 16/04 114/221 R |
| 6,027,386 | A | * | 2/2000 | Hains | B63B 13/00 114/221 R |
| 6,055,762 | A | * | 5/2000 | Philpot | A01K 77/00 92/163 |
| 6,544,087 | B1 | * | 4/2003 | Peng | B63H 16/04 440/101 |
| 10,946,947 | B1 | * | 3/2021 | Tseng | B63H 16/04 |
| 2011/0013971 | A1 | * | 1/2011 | Peng | F16B 7/149 403/109.1 |
| 2020/0277034 | A1 | * | 9/2020 | Dufault | B63H 11/04 |
| 2021/0253212 | A1 | * | 8/2021 | Dufault | F04B 9/14 |

FOREIGN PATENT DOCUMENTS

| | | | | | |
|---|---|---|---|---|---|
| TW | M590565 | U | | 2/2020 | |
| TW | M615306 | U | * | 5/2021 | B63H 16/04 |

* cited by examiner (A-A)

(B-B)

BUILT-IN WATER PUMPING DEVICE OF MANUAL PADDLE FOR BOAT

FIELD OF THE INVENTION

The present invention relates to a paddle, and more particularly to a built-in water pumping device of a manual paddle for a boat.

BACKGROUND OF THE INVENTION

A conventional paddle is applied to row a boat in waters manually, but the waters will spatter into the boat or flow into the boat when a cutout produces on the boat.

The conventional paddles are disclosed in U.S. Pat. Nos. 5,163,778, 5,322,462, and 6,027,386 and are used to pump waters by extending or retracting a pump structure of a shaft of the paddle, wherein a pumping orifice is defined adjacent to a distal end of a blade, thus pumping the waters.

In operation, the paddle is lifted so as to remove the blade from the waters, and the blade is inserted into a water accommodation zone of the boat. However, it is difficult to operate the paddle to pump the waters because the boat shakes and the paddle is long.

A water pumping paddle is disclosed in TW M590565 and contains a discharge orifice defined on a handle of the paddle so as to pump and discharge the waters.

Nevertheless, the water pumping paddle has defects as follows:

1. The discharge orifice is defined on the handle, so the waters accumulate in corners of the handle.
2. The discharge orifice of the handle is perpendicular to the receiving chamber, so the waters cannot be absorbed easily.
3. The waters are absorbed and remain in the receiving chamber, hence they cannot be discharged out of the discharge orifice continuously.

The present invention has arisen to mitigate and/or obviate the afore-described disadvantages.

SUMMARY OF THE INVENTION

The primary aspect of the present invention is to provide a built-in water pumping device of a manual paddle for a boat which contains a shaft comprised of an inner tube and an outer tube so as to pump waters, such that when pulling the outer tube and the inner tube outward and pushing the outer tube and the inner tube inward, the waters are absorbed and discharged out of the boat easily.

Further aspect of the present invention is to provide a built-in water pumping device of a manual paddle for a boat by which the outer tube and the inner tube are pulled outward and pushed inward, so that the waters are absorbed and discharged out of the boat continuously and efficiently.

Another aspect of the present invention is to provide a built-in water pumping device of a manual paddle for a boat which contains at least one outlet defined on the blade and communicating with the receiving chamber so as to discharge the waters out of the at least one outlet, thus playing a water fight joyfully.

To obtain above-mentioned aspects, a built-in water pumping device of a manual paddle for a boat provided by the present invention contains: a shaft, a blade connected on an end of the shaft, an adjustable fitting sleeve, and a water absorption head.

The shaft includes an inner tube and an outer tube movably fitted with the inner tube so as to movably adjust a length of the shaft, thus pumping the waters. The adjustable fitting sleeve is configured to lock or unlock the inner tube and the outer tube after adjusting the length of the shaft. The shaft further includes a receiving chamber defined in the shaft.

The blade is fitted on the inner tube, and the water absorption head is fixed on a bottom of the outer tube and is formed in a grip shape. The water absorption head has a passing orifice defined on a center thereof and connected with the receiving chamber; the blade includes at least one outlet formed thereon and communicating with the receiving chamber, such that the inner tube is actuated to absorb the waters into the receiving chamber from the passing orifice of the water absorption head, and the inner tube is pulled back and forth so that the waters discharge out of the at least one outlet of the blade continuously.

Accordingly, the built-in water pumping device of the manual paddle of the present invention has advantages as follows:

1. The blade includes at least one orifice so that when the inner tube and the outer tube are pulled outward and are pushed inward reciprocately, the water absorption head of the outer tube is extended into the water accommodation zone of the boat to discharge the waters out of the at least one outlet quickly and efficiently.
2. The manual paddle is applied to play a water fight by using the at least one outlet of the blade in a water park, thus enhancing usages vividly.
3. The shaft further includes one or two water absorption heads connected on one or two ends of the shaft, wherein the one or two water absorption heads are formed in a grip or a funnel shape so as to be extended into a water accommodation zone of the boat, thus discharging the water out of the boat quickly and easily.

DETAILED DESCRIPTION OF THE PREFERRED EMBODIMENTS

Figure 1:
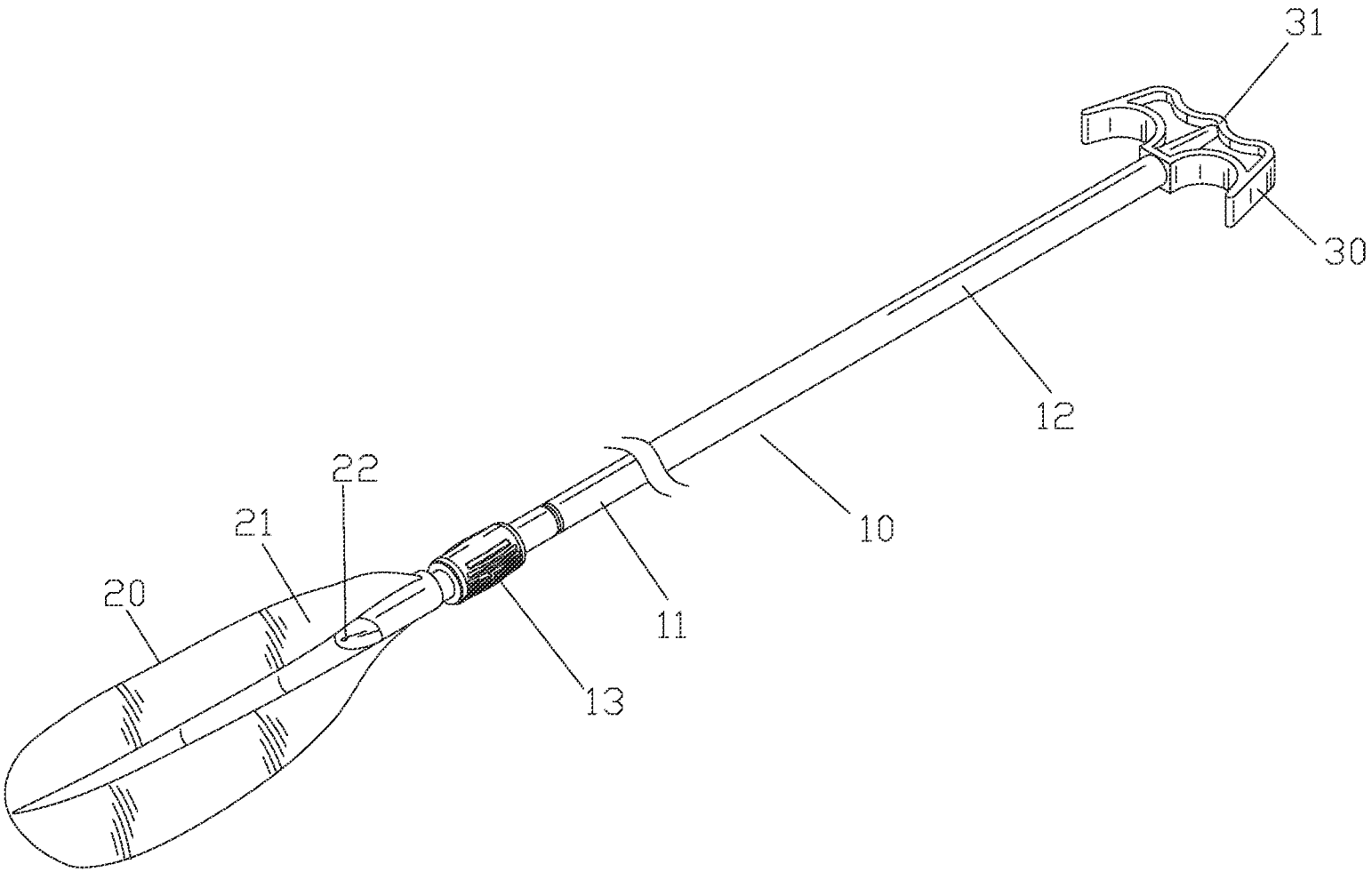
FIG. 1 is a perspective view showing the assembly of a built-in water pumping device of a manual paddle for a boat according to a first embodiment of the present invention.
Figure 2:
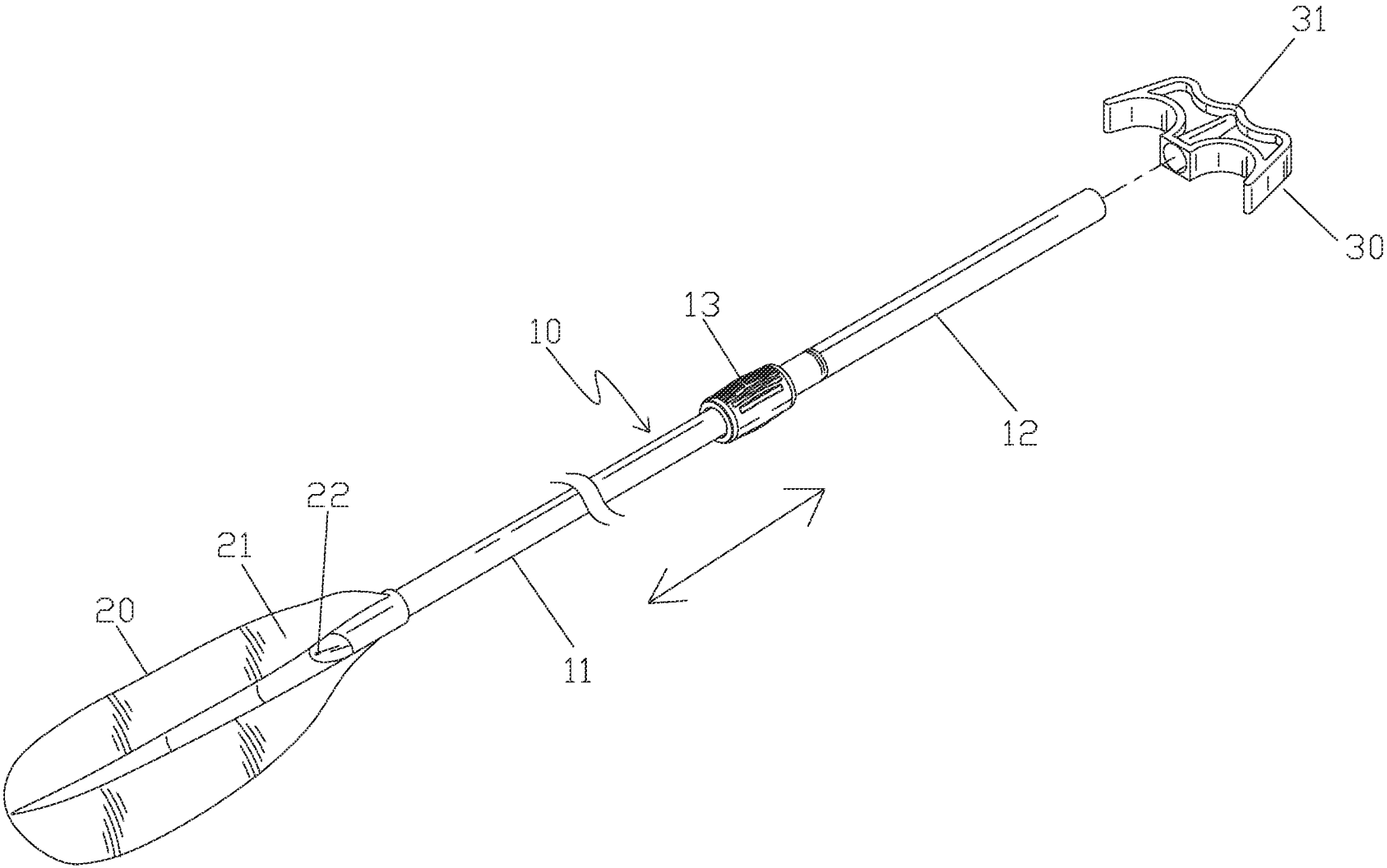
FIG. 2 is a perspective view showing the exploded components of the built-in water pumping device of the manual paddle according to the first embodiment of the present invention.

With reference to FIGS. 1-2, a built-in water pumping device of a manual paddle for a boat according to a preferred embodiment of the present invention comprises: a shaft 10, a blade 20, and a water absorption head 30 formed in a grip shape.

Figure 3:
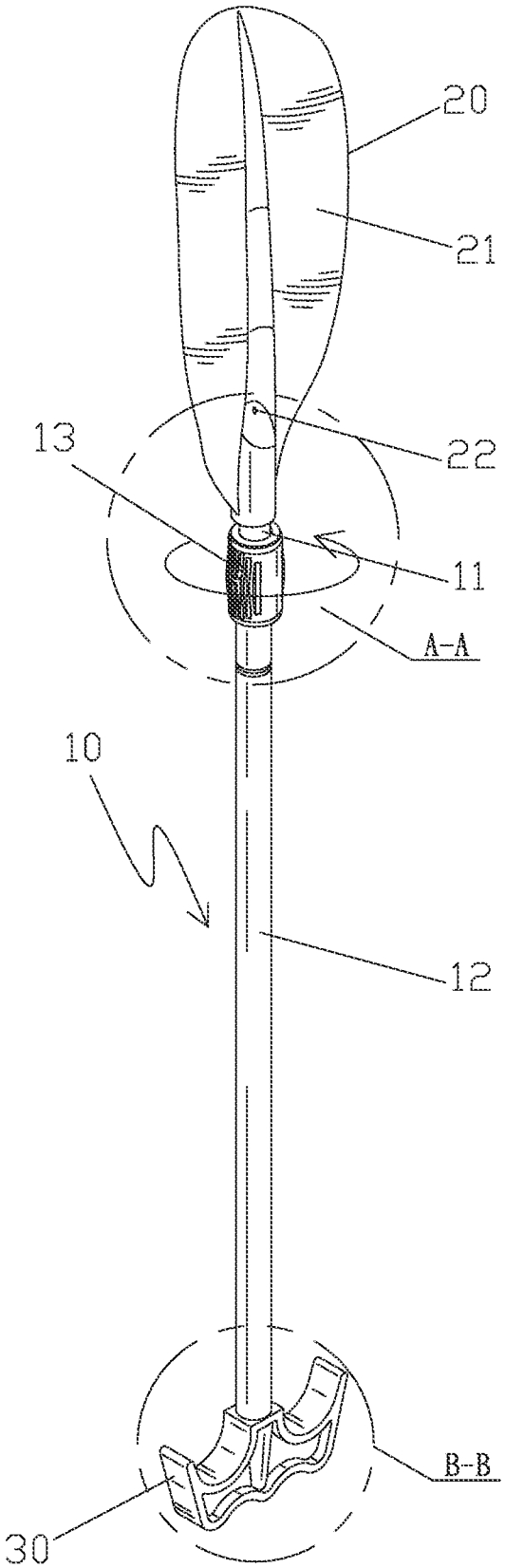
FIG. 3 is a perspective view showing the operation of the built-in water pumping device of the manual paddle according to the first embodiment of the present invention.
Figure 4:
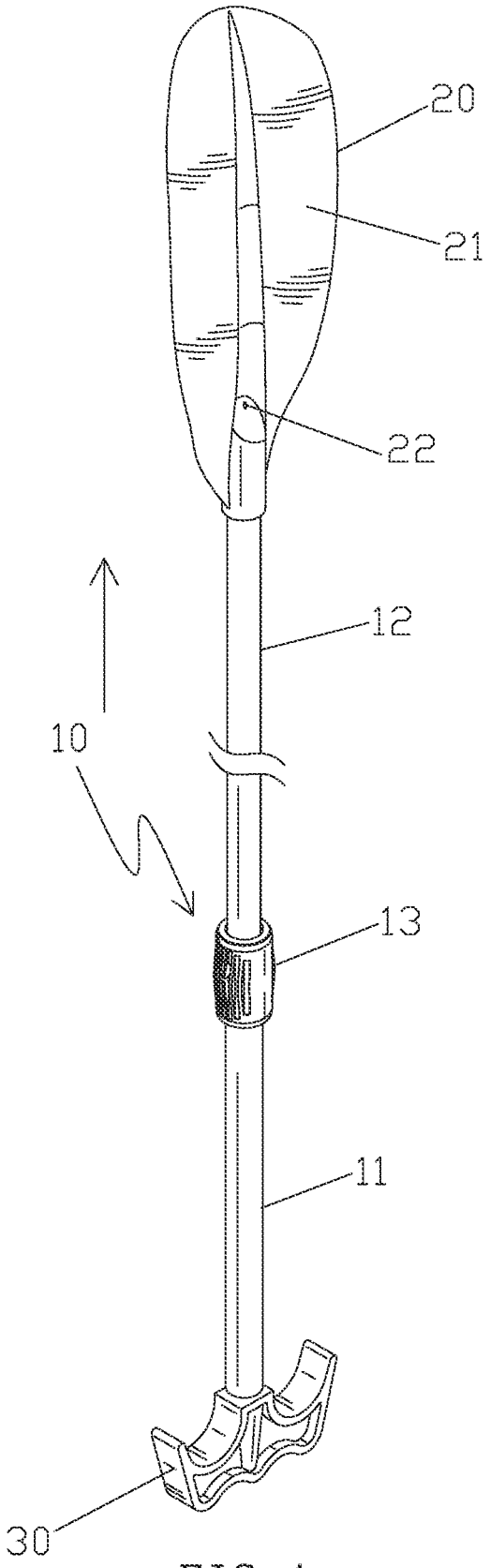
FIG. 4 is another perspective view showing the operation of the built-in water pumping device of the manual paddle according to the first embodiment of the present invention.
Figure 5:
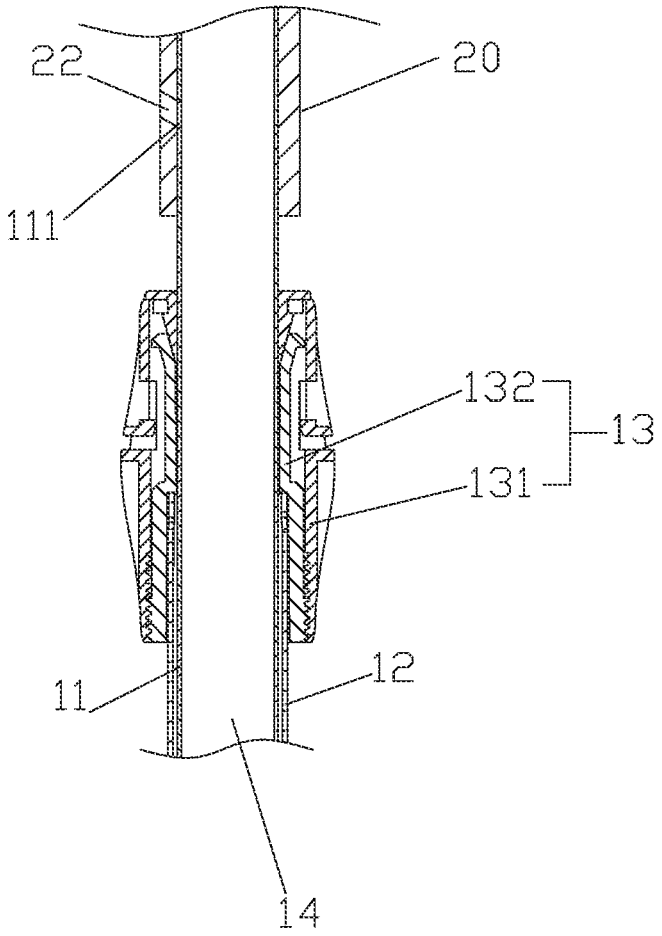
FIG. 5 is a cross sectional taken along the line A-A of FIG. 3.

Referring to FIGS. 1-3, the shaft 10 includes an inner tube 11 and an outer tube 12 movably fitted with the inner tube 11 so as to movably adjust a length of the shaft 10, thus pumping waters; an adjustable fitting sleeve 13 configured to lock the inner tube 11 and the outer tube 12 after adjusting the length of the shaft 10 and to remove the inner tube 11 from the outer tube 12 so as to move the inner tube 11 with respect to the outer tube 12. As shown in FIGS. 4-5, the shaft 10 includes a receiving chamber 14 defined therein and configured to accommodate the waters absorbed from the receiving chamber 14.

As illustrated in FIGS. 1-5, the blade 20 is fitted on a top of the inner tube 11 of the shaft 10, and the inner tube 11 has a through orifice 111 defined on a top of the inner tube 11, wherein the blade 10 includes at least one outlet 22 formed on the blade 21 and corresponding to the through orifice 111, and the through orifice 111 and the at least one outlet 22 are in communication with the receiving chamber 14.

With reference to FIGS. 1-3 and 6, the water absorption head 30 is fixed on a bottom of the outer tube 12, and the water absorption head 30 has a passing orifice 31 defined on a center of the water absorption head 30, a check valve 32 received in the passing orifice 31, wherein the passing orifice 31 is connected with the receiving chamber 14. When moving the inner tube 11, the receiving chamber 14 produces a pressure difference so that the waters are absorbed into the receiving chamber 14 from the water absorption head 30. Furthermore, the receiving chamber 14 further has a piston 33 configured to push the waters into the inner tube 11 from the receiving chamber 14 so as to enhance a spray force and a spray distance of the waters from the at least one outlet 22.

With reference to FIGS. 4-5, the adjustable fitting sleeve 13 is fitted among the inner tube 11, the outer tube 12, and the blade 20. The adjustable fitting sleeve 13 has a first retainer 131 and a second retainer 132 engaged with the first retainer 131, such that the second retainer 132 is adjustably rotated to engage with the first retainer 131 tightly or loosely. When rowing the manual paddle, the length of the shaft 10 is adjustable by ways of the adjustable fitting sleeve 13. When desiring to pump the waters, the adjustable fitting sleeve 13 is rotated loosely to move the inner tube 11 and the outer tube 12.

Figure 6:
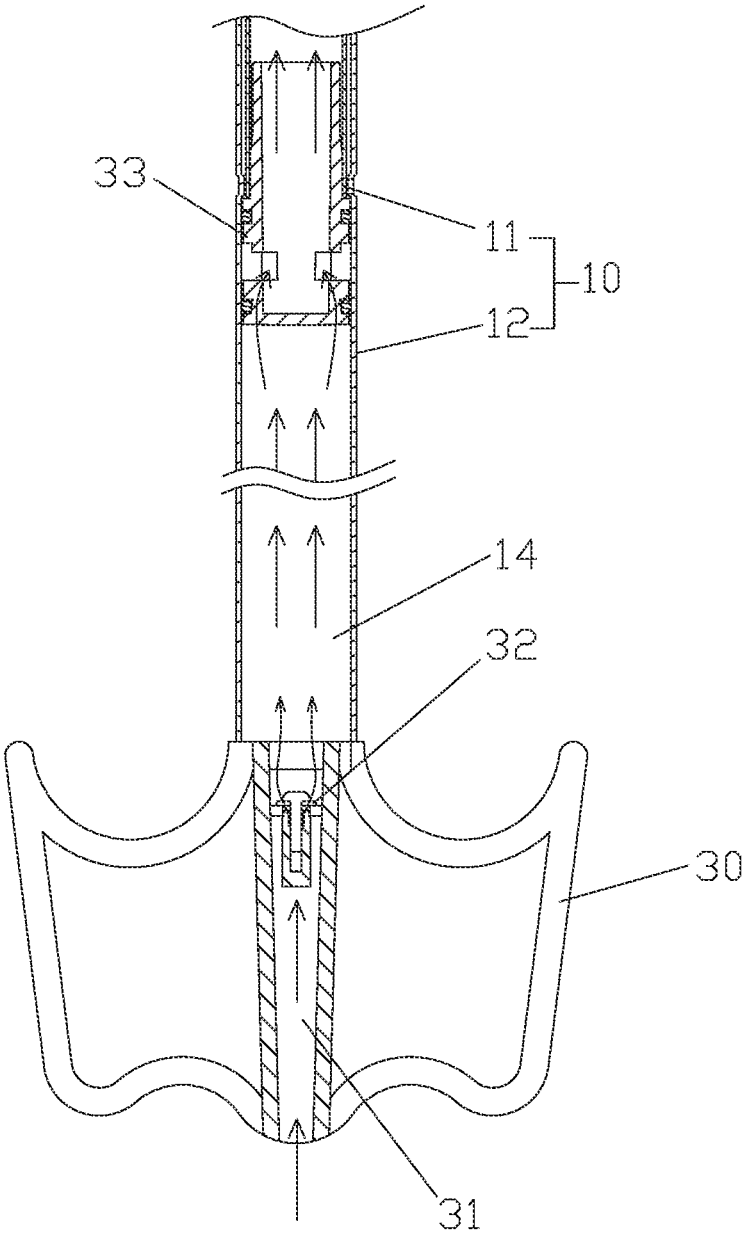
FIG. 6 is a cross sectional taken along the line B-B of FIG. 3.

Referring to FIGS. 2-7, when desiring to pump the waters, the adjustable fitting sleeve 13 is rotated loosely so that the inner tube 11 and the outer tube 12 are movably, as shown in FIG. 4. With reference to FIG. 6, the water absorption head 30 is extended into a water accommodation zone of the boat, and the inner tube 11 is pulled (because the outer tube 12 is fixed in the water accommodation zone so as to absorb the waters) back and forth so that the pressure difference produces in the receiving chamber 14 of the shaft 10, and the waters are absorbed into the receiving chamber 14, wherein the inner tube 11 is pulled continuously. Since the water absorption head 30 includes the check valve 32 to stop the waters of the receiving chamber 14 flowing out of the manual paddle, and the waters are discharged out of the at least one outlet 22 from the receiving chamber 14 via the through orifice 111. Thereby, it is easy to discharge the waters by pulling the inner tube 11 effectively.

Figure 7:
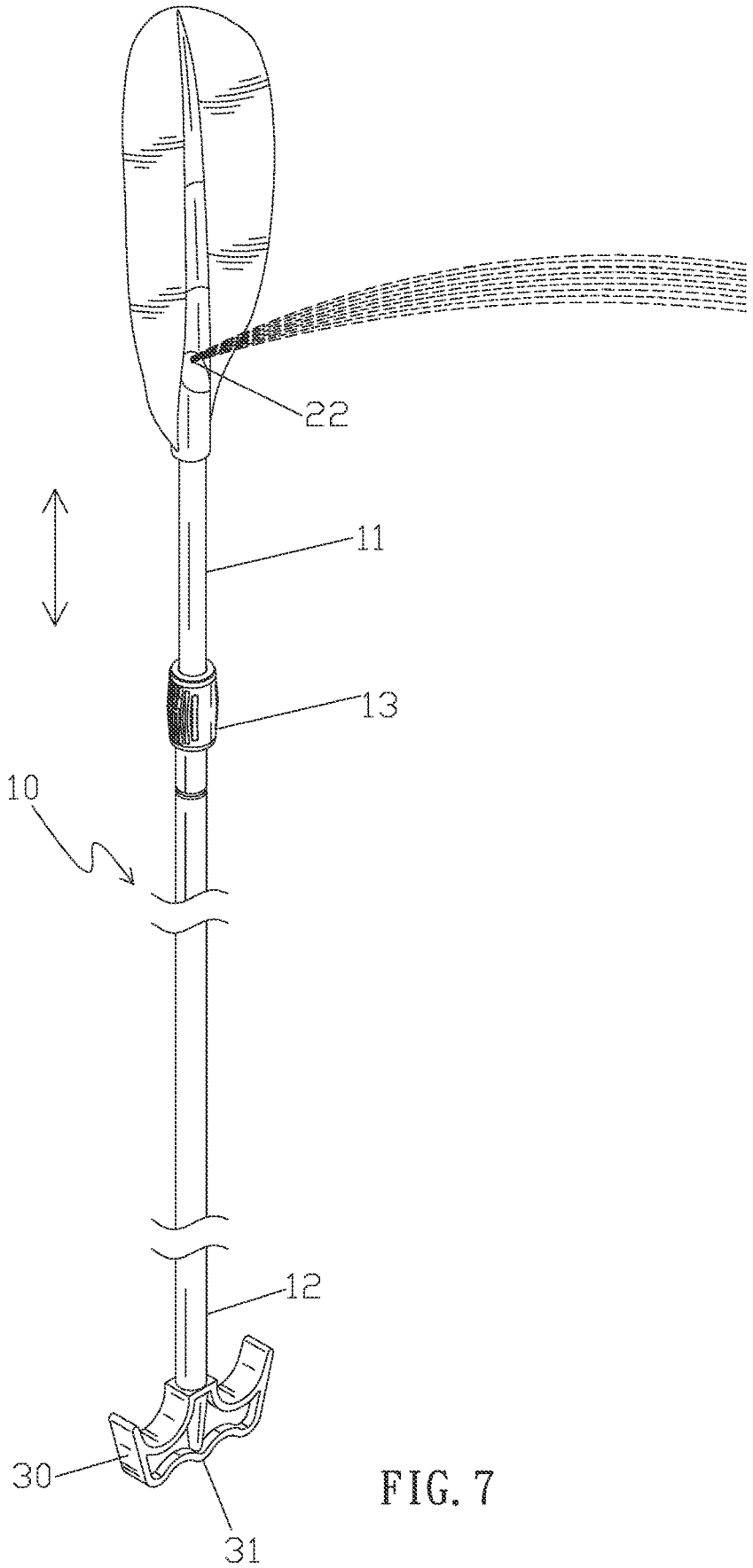
FIG. 7 is a perspective view showing the operation of the built-in water pumping device of the manual paddle according to the first embodiment of the present invention.

With reference to FIG. 7, when the manual paddle of the present invention is applied to row in a playground, such as a water park, the manual paddle absorbs and discharges the waters effectively. Preferably, the water absorption head 30 is extended into the waters, and the inner tube 12 absorbs and discharges the waters out of the at least one outlet 22, thus having a water fight.

Figure 8:
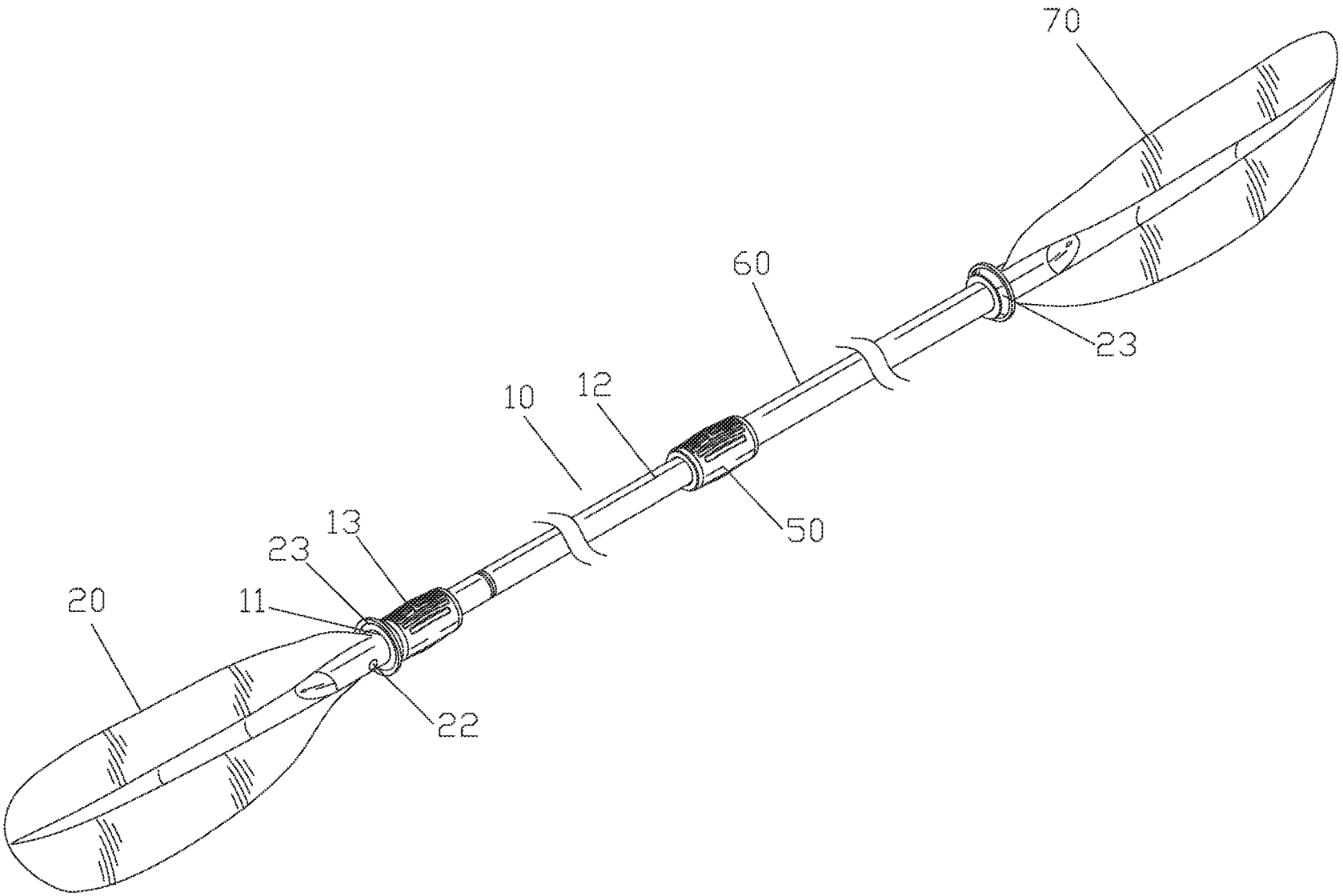
FIG. 8 is a perspective view showing the assembly of a built-in water pumping device of a manual paddle for a boat according to a second embodiment of the present invention.
Figure 9:
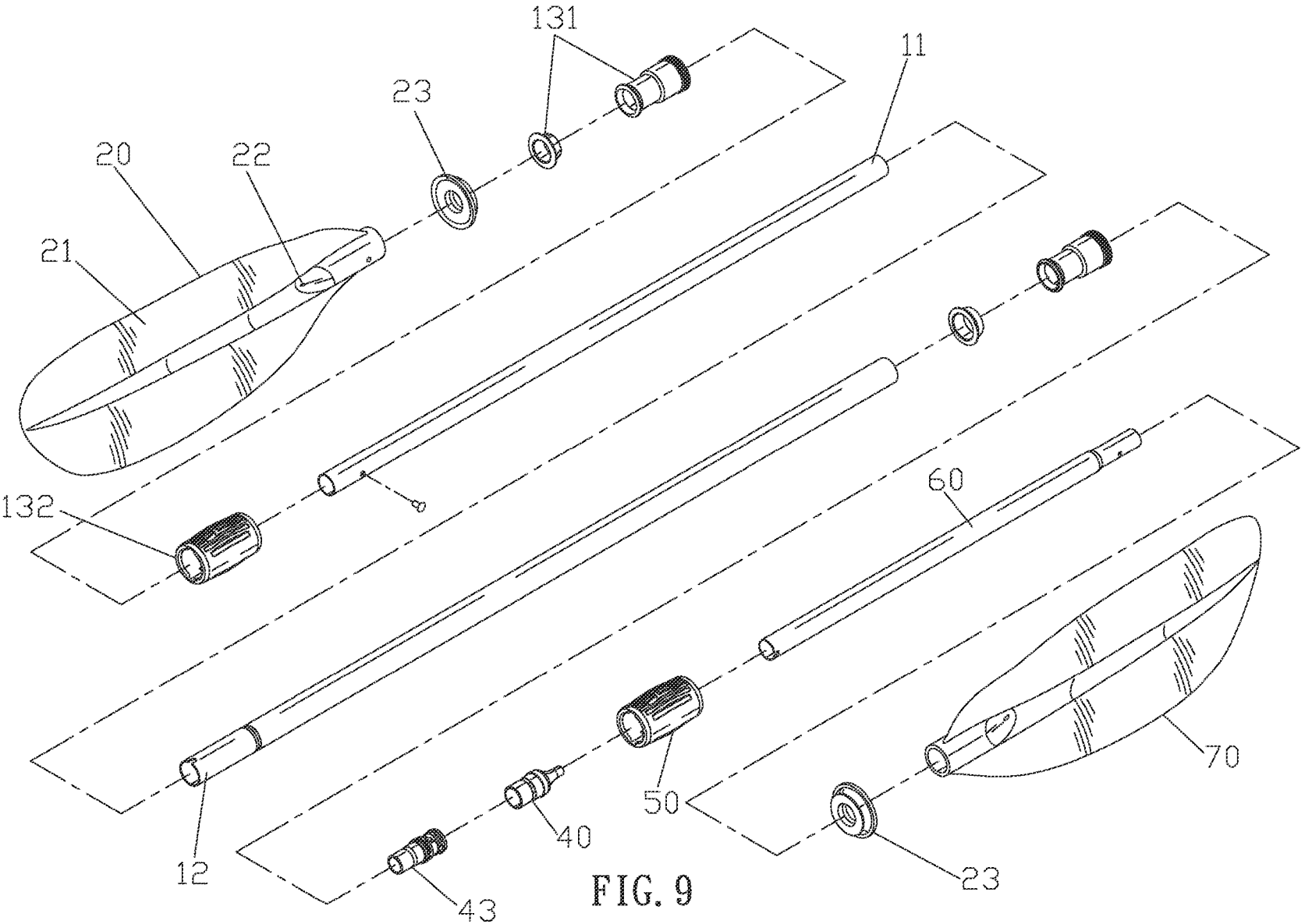
FIG. 9 is a perspective view showing the exploded components of the built-in water pumping device of the manual paddle for the boat according to the second embodiment of the present invention.

With reference to FIGS. 8-9, a difference of a built-in water pumping device of a manual paddle of a second embodiment comprises: a shaft 10, a blade 20, a water absorption head 40, a second adjustable fitting sleeve 50, a second outer tube 60, and a second blade 70, wherein a structure of the shaft 10 and the blade 20 is the same as that of the shaft 10 and the blade 20 of the first embodiment. In other words, the manual paddle of the second embodiment comprises the blade 20 and the second blade 70 which are connected on two ends of the shaft 10.

The manual paddle of the second embodiment comprises the water absorption head 40 formed in a funnel shape, the second adjustable fitting sleeve 50 is configured to connect the second outer tube 60 and the shaft 10, and the second blade 70 is connected with the second outer tube 60, wherein the water absorption head 40 is hidden in the second outer tube 60 when rowing the boat, and the operation of the second adjustable fitting sleeve 50 is the same as that of the adjustable fitting sleeve 13, hence further remarks are omitted.

Figure 10:
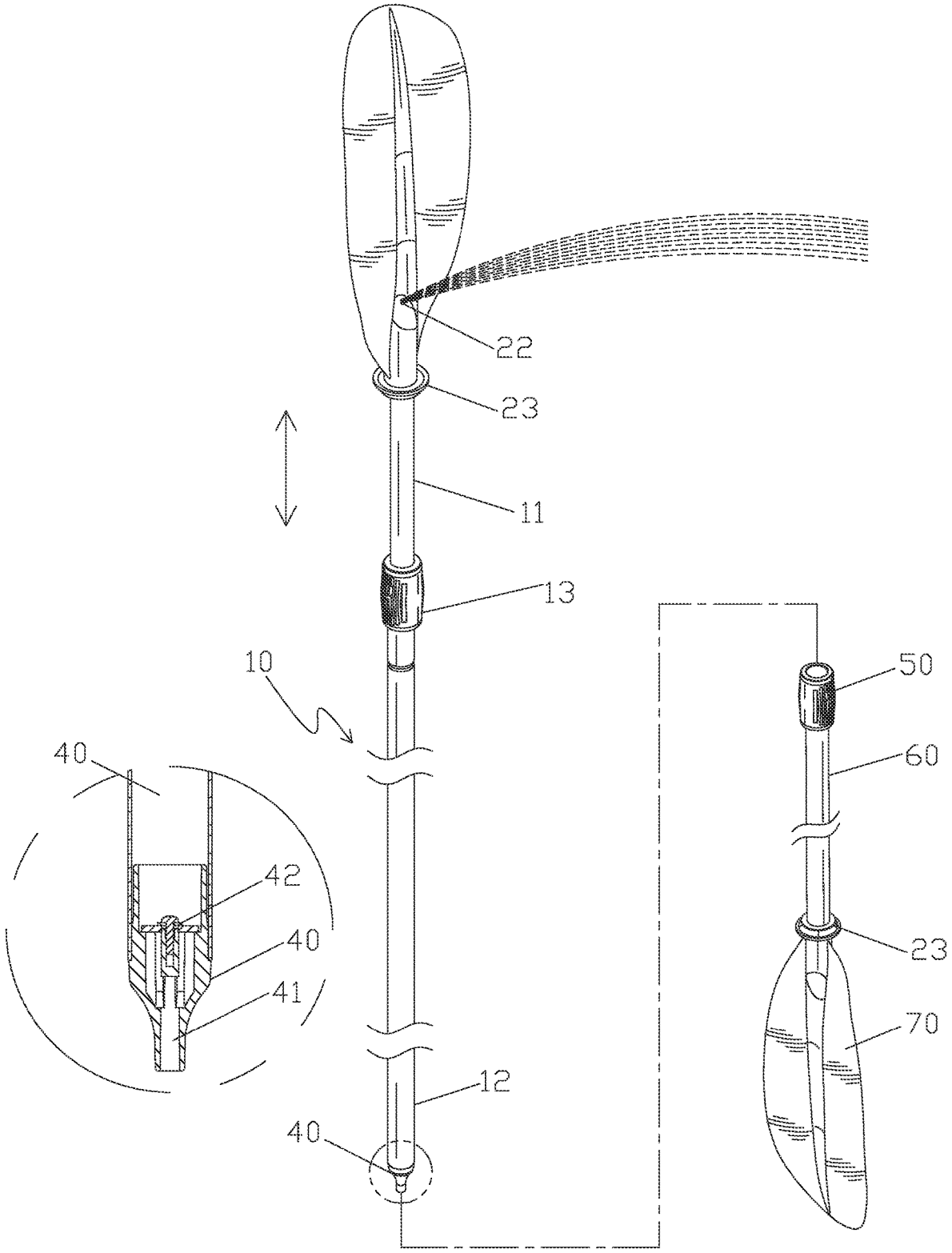
FIG. 10 is a perspective view showing the operation of the built-in water pumping device of the manual paddle according to the second embodiment of the present invention.

Referring to FIGS. 8-10, in operation, the manual paddle is swung backward and forth, and a stop plug 23 is defined between the inner tube 11 and the blade 20 so as to stop the waters dropping onto a user's hand along the blade 20 or the second blade 70.

As shown in FIGS. 9-10, the water absorption head 40 has a passing orifice 41, a check valve 42, and a piston 43. Since the structure and the operation of the passing orifice 41, the check valve 42, and the piston 43 are the same as those of the passing orifice 31, the check valve 32, and the piston 33, further remarks are omitted.

As illustrated in FIG. 10, the second adjustable fitting sleeve 50 is configured to remove the second outer tube 60 and the second blade 70 so as to absorb the waters as described in the first embodiment, thus rowing the manual in a rowing race easily and safely.

While the preferred embodiments of the invention have been set forth for purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A water pumping device built-in a manual paddle for a boat, comprising:

a shaft, a first blade connected on a first end of the shaft, and the shaft including an inner tube and a first outer tube movably fitted with the inner tube so as to movably adjust a length of the shaft;

an adjustable fitting sleeve configured to lock or unlock the inner tube and the first outer tube after adjusting the length of the shaft;

the shaft further including a receiving chamber defined in the shaft;

wherein the first blade is connected on the inner tube, and the first outer tube has a water absorption head fixed on an end thereof and formed in a funnel shape, the water absorption head has a passing orifice defined on a center thereof and connected with the receiving chamber;

the first blade includes at least one outlet formed thereon and communicating with the receiving chamber, such that the water pumping device is actuated by back and forth movement of the inner tube to absorb the water into the receiving chamber from the passing orifice of the water absorption head, and discharge the water out of the at least one outlet of the first blade; and a second blade connected on a second outer tube, the second outer tube configured to connect on the bottom of the first outer tube at a second end of the shaft such that the water absorption head is hidden in the second outer tube.

2. The built-in water pumping device as claimed in claim 1, wherein a stop plug is defined between the inner tube and the first blade.

3. The built-in water pumping device as claimed in claim 1, wherein a check valve is received in the passing orifice and is in communication with the receiving chamber, such that when moving the inner tube, the receiving chamber produces a pressure difference so that the water is absorbed into the receiving chamber from the water absorption head, and the check valve stops the water in the receiving chamber from flowing out of the water absorption head.

4. The built-in water pumping device as claimed in claim 1, wherein the receiving chamber further has a piston configured to push the water into the inner tube so as to enhance a spray force and a spray distance of the water discharging from the at least one outlet.

* * * * *